US005154383A

United States Patent [19]

Collinson

[11] Patent Number: 5,154,383

[45] Date of Patent: Oct. 13, 1992

[54] LADDER-MOUNTABLE HOLDER FOR PAINT CANS AND THE LIKE

[76] Inventor: Nigel J. Collinson, 45 Tremont Drive, Halifax, Nova Scotia, Canada, B3M 1X8

[21] Appl. No.: 780,232

[22] Filed: Oct. 22, 1991

[51] Int. Cl.[5] ..... E06C 7/14

[52] U.S. Cl. ..... 248/211; 182/129

[58] Field of Search ..... 248/210, 211; 182/129

[56] References Cited

U.S. PATENT DOCUMENTS

| | | | |
|---|---|---|---|
| 376,825 | 1/1888 | Kent | 248/211 |
| 4,658,455 | 4/1987 | Skillern | 248/211 |
| 4,787,586 | 11/1988 | Crain | 248/210 |
| 5,054,581 | 10/1991 | Henson | 248/210 |

*Primary Examiner*—Reinaldo P. Machado
*Attorney, Agent, or Firm*—R. Craig Armstrong

[57] ABSTRACT

The holder has an elongated base portion adapted to extend from above one rung of a ladder to below an immediately lower rung, and an elongated cantilevered portion extending integrally from the upper end of the base portion at an angle of preferably less than 90 degrees therefrom. The distal end of the cantilevered portion has an upward hook-like projection to support the bail or handle of a paint can or the like. Preferably, a substantial portion of the cantilevered portion has a cross-section in the form of an upwardly-opening U-shape defining a trough to hold a paint brush, with a drain hole being provided through the bottom of the trough near the distal end. The cantilevered portion preferably has a dam piece near its distal end between the distal end and the location of the drain hole, so that paint cannot run past the dam piece, and can only drain out the drain hole.

11 Claims, 4 Drawing Sheets

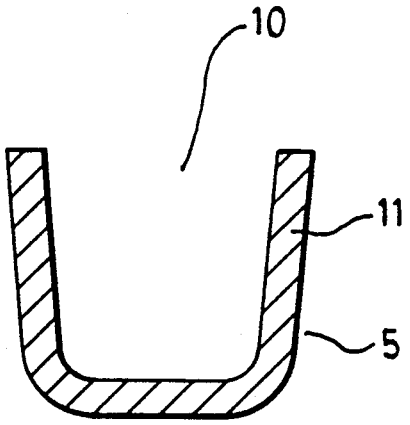
FIG. 5.
FIG. 6.
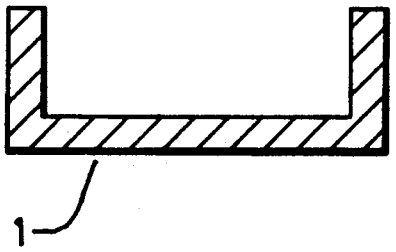
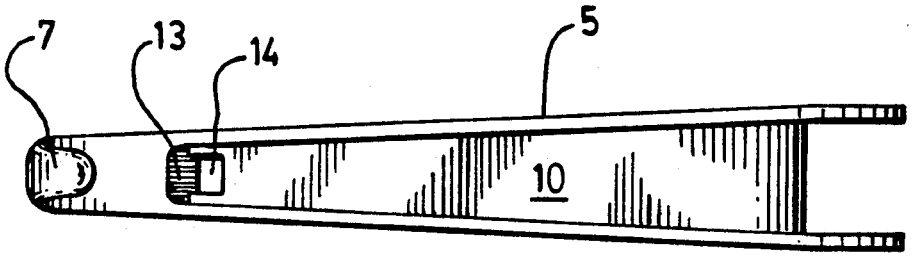
FIG. 7.

LADDER-MOUNTABLE HOLDER FOR PAINT CANS AND THE LIKE

BACKGROUND OF THE INVENTION

This invention relates to a device for suspending a paint can, bucket, pail or the like from a ladder, preferably including an area to accommodate a paint brush or other implement.

Many devices for suspending pails or buckets from a ladder which engage a ladder rung and the bail or handle of a paint can or bucket are known. Many prior art devices rely on some sort of clamping mechanism having at one end a screw member engaging a base member and adapted to clamp the side or rim of a paint can to the base member, and having at the other end an arm adapted to engage a ladder rung.

However, none of the prior art devices known to the inventor have the simplicity of structure and the convenience of use provided by the present invention.

SUMMARY OF THE INVENTION

In the invention, the holder has an elongated base portion adapted to extend from above one rung of a ladder to below an immediately lower rung, and an elongated cantilevered portion extending integrally from the upper end of the base portion at an angle of preferably less than 90 degrees therefrom. The distal end of the cantilevered portion has an upward hook-like projection to support the bail or handle of a paint can or the like.

Preferably, a substantial portion of the cantilevered portion has a cross-section in the form of an upwardly-opening U-shape defining a trough, with a drain hole being provided through the bottom of the trough near the distal end.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which:

FIG. 1 is a perspective view of the holder, installed on a ladder and holding a paint can or the like;

FIG. 5 is a cross-section through the cantilevered portion of holder;

FIG. 6 is a cross-section through the base portion of the holder;

FIG. 7 is a top view of the holder;

DETAILED DESCRIPTION OF THE PREFERRED EMBODIMENT

Figure 1:
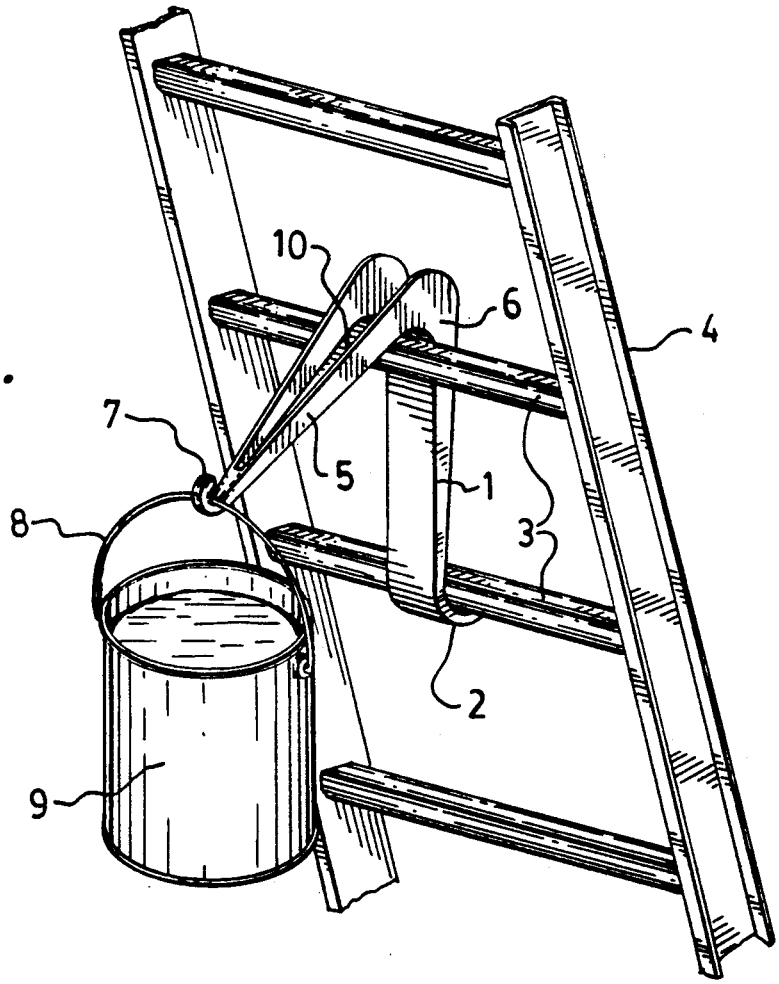

Referring to FIG. 1, the preferred embodiment of the holder is of one-piece construction, and is preferably but not essentially made of metal. The holder includes a base portion 1, preferably with a curved end 2 to wrap partially around the lower of two rungs 3 of a ladder 4, the base portion being adapted to extend from above one rung to just an immediately lower rung.

An elongated cantilevered portion 5 extends integrally from the upper end of the base portion at an angle, preferably less than 90 degrees to minimize the likelihood of the holder being knocked off the ladder. In the preferred embodiment, the angle is actually about 65 degrees. Preferably the base portion and the cantilevered portion are joined by a smoothly curved area 6.

The distal end of the cantilevered portion has a solid upward projection defining a hook 7 to support the bail or handle 8 of a paint can 9 or the like.

Figure 2:
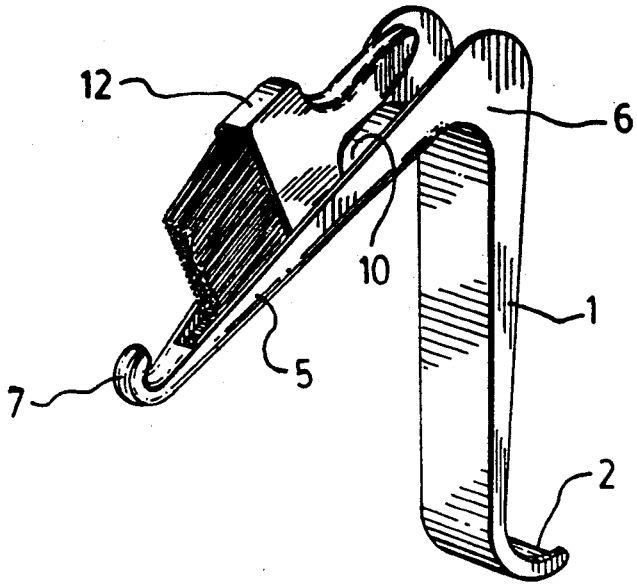
FIG. 2 is a perspective view of the holder, shown holding a paint brush.
Figure 3:
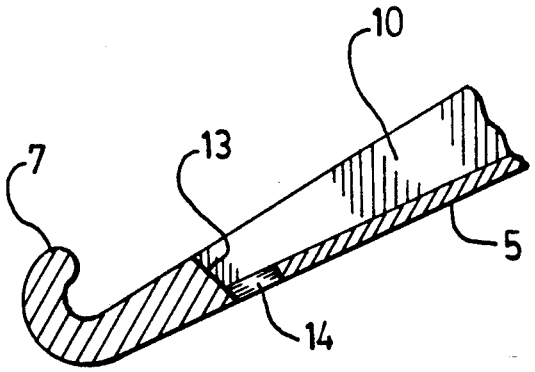
FIG. 3 is a side view of the holder.
Figure 9:
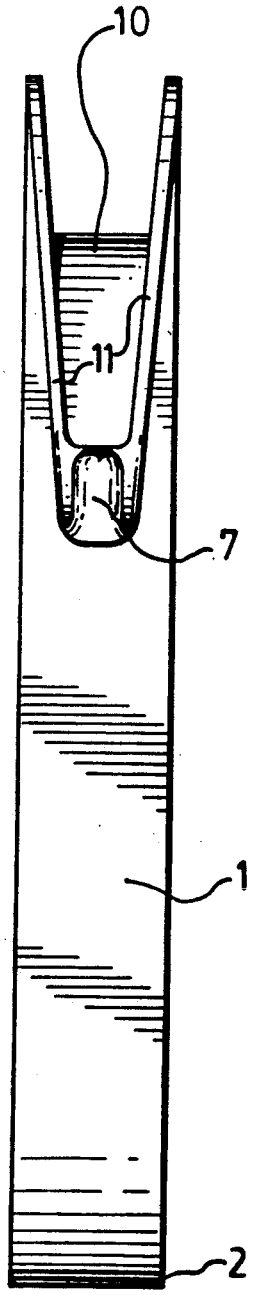
FIG. 9 is a front view of the holder.

As seen in FIG. 5, the cantilevered portion 5 preferably has a fairly deep U-shaped cross-section, defining a trough 10, preferably with sides 11 which taper inwardly both in cross-section and from proximal to distal ends (see FIGS. 7 and 9). Thus, as shown in FIG. 2, a paint brush 12 can be readily retained within the trough. The trough helps to maintain the bristle shape. The U-shape of course also provides greater strength for the cantilevered portion, so that a minimum of material can be used.

Figure 4:
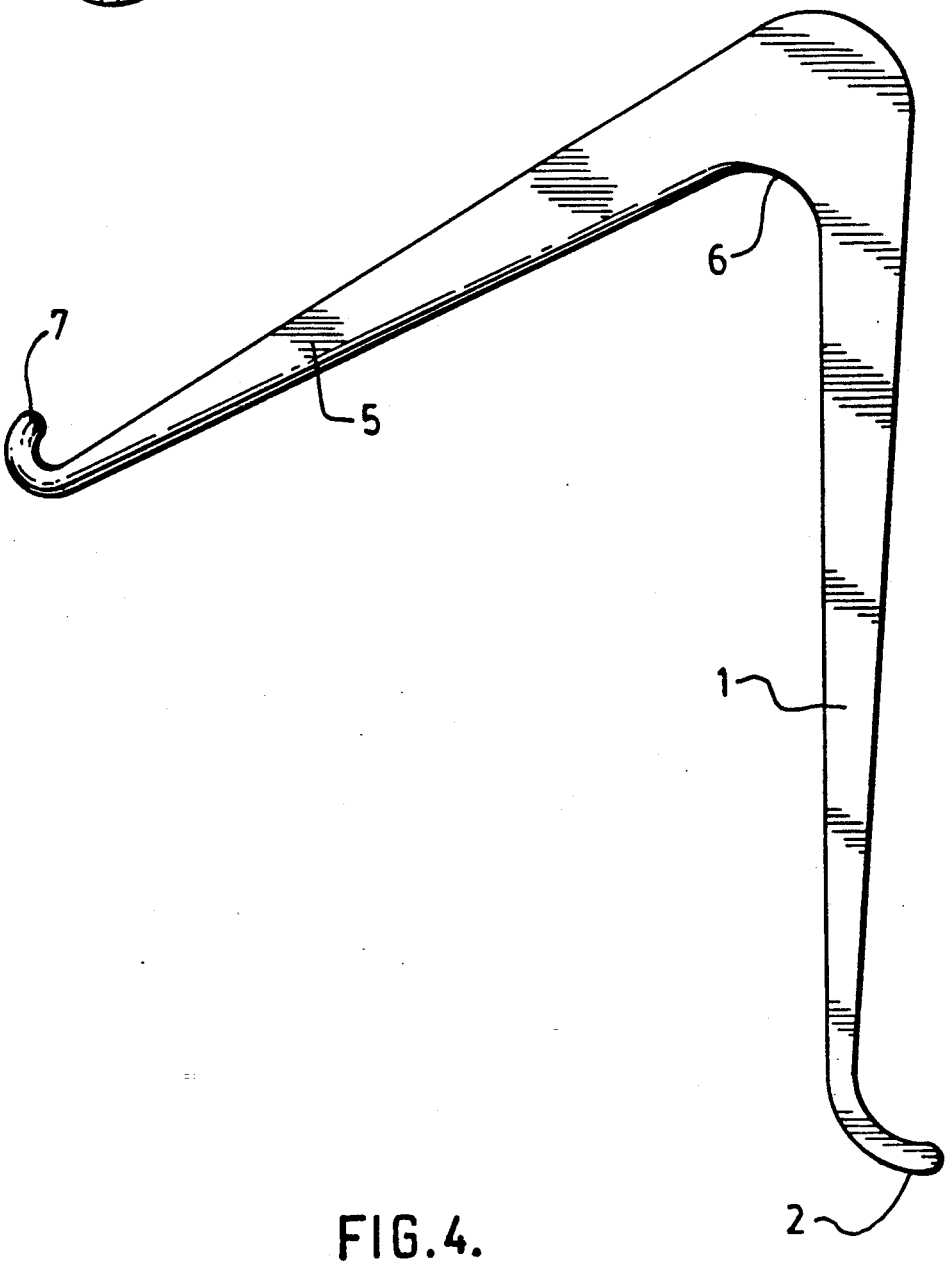
FIG. 4 is a cross-section of the distal end of the holder.
Figure 8:
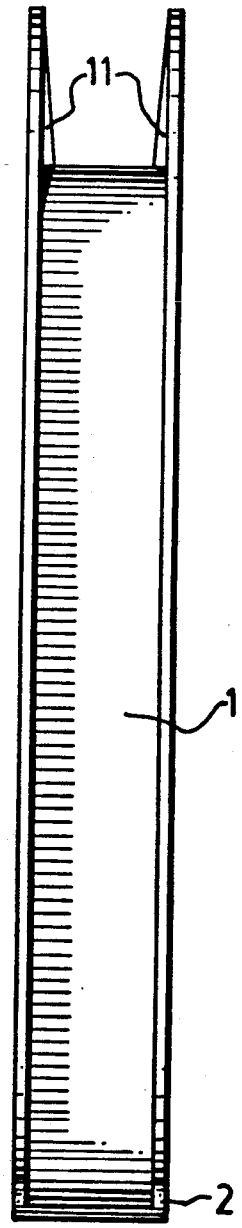
FIG. 8 is a rear view of the holder.

As seen in FIG. 4, a small vertical wall or dam 13 near the distal end of the U-shape prevents the brush from sliding further down the U-shape, and also prevents paint from running further down the U-shape. A drain hole 14 allows paint to drain out of the U-shape. Since the drain hole is close to the location of the hook 6, any paint dropping through the drain hole falls directly into the paint can.

As seen in FIG. 6, the base portion 1 also is preferably U-shaped in cross-section, simply to provide the holder with sufficient strength without requiring any more metal or other material than is necessary.

It will be appreciated that the above description relates to the preferred embodiment by way of example only. Certain variations on the invention will be obvious to those knowledgeable in the field, and such obvious variations are within the scope of the invention as described and claimed, whether or not expressly described.

It will be appreciated that the invention is not limited to use with paint cans, but could be used to support many kinds of containers or other items from a ladder. The broad claims which follow are therefore not limited to the invention as used with a paint can and paint brush.

What is claimed as the invention is:

1. A holder, comprising an elongated base portion having a lower end and an upper end, said base portion having a lower end and an upper end, said base portion being adapted to extend from above one rung of a ladder to below an immediately lower rung, and an elongated cantilevered portion extending integrally from the upper end of said base portion at an angle of less than 90 degrees therefrom and having a distal end remote from said base portion, said distal end having an upwardly-directed projection defining a hook, where a substantial portion of said cantilevered portion has a cross-section in the form of an upwardly-opening U-shape, thereby defining a trough.

2. A holder as recited in claim 1, where said cantilevered portion has a drain hole through the bottom of said trough near said distal end.

3. A holder as recited in claim 2, where said cantilevered portion has a dam piece near said distal end between said distal end and the location of said drain hole, said dam piece being positioned across said trough, thereby preventing any liquid in said trough from running past said dam piece, whereby any said liquid can only drain out said drain hole.

4. A holder as recited in claim 1, where the lower end of said base portion is curved away from said cantilevered portion, where the distance from where the underside of said cantilevered portion joins said base portion to the beginning of said curved lower portion of said base is about one foot so as to correspond to a ladder rung spacing of one foot, and where the angle between said cantilevered portion and said base portion is in the range of about 50 degrees to 80 degrees.

5. A holder as recited in claim 2, where the lower end of said base portion is curved away from said cantilevered portion, where the distance from where the underside of said cantilevered portion joins said base portion to the beginning of said curved lower portion of said base is about one foot so as to correspond to a ladder rung spacing of one foot, and where the angle between said cantilevered portion and said base portion is in the range of about 50 degrees to 80 degrees.

6. A holder as recited in claim 3, where the lower end of said base portion is curved away from said cantilevered portion, where the distance from where the underside of said cantilevered portion joins said base portion to the beginning of said curved lower portion of said base is about one foot so as to correspond to a ladder rung spacing of one foot, and where the angle between said cantilevered portion and said base portion is in the range of about 50 degrees to 80 degrees.

7. A holder as recited in claim 4, where the angle between said cantilevered portion and said base portion is about 65 degrees.

8. A holder as recited in claim 5, where the angle between said cantilevered portion and said base portion is about 65 degrees.

9. A holder as recited in claim 6, where the angle between said cantilevered portion and said base portion is about 65 degrees.

10. A holder, comprising an elongated base portion having a lower end and an upper end, said base portion being adapted to extend from above one rung of a ladder to below an immediately lower rung, and an elongated cantilevered portion extending integrally from the upper end of aid base portion at an angle of less than 90 degrees therefrom and having a distal end remote from said base portion, said distal end having an upwardly-directed projection defining a hook, where the lower end of said base portion is curved away from said cantilevered portion, where the distance from where the underside of said cantilevered portion joins said base portion to the beginning of said curved lower portion of said base is about one foot so as to correspond to a ladder rung spacing of one foot, and where the angle between said cantilevered portion and said base portion is in the range of about 50 degrees to 80 degrees.

11. A holder as recited in claim 10, where the angle between said cantilevered portion and said base portion is about 65 degrees.

* * * * *